US006389798B1

(12) United States Patent
Tilston et al.

(10) Patent No.: US 6,389,798 B1
(45) Date of Patent: May 21, 2002

(54) COMBUSTOR FLOW CONTROLLER FOR GAS TURBINE

(75) Inventors: John Ronald Tilston; John Austin, both of Farnborough (GB)

(73) Assignee: Qinetiq Limited, London (GB)

( * ) Notice: Subject to any disclaimer, the term of this patent is extended or adjusted under 35 U.S.C. 154(b) by 0 days.

(21) Appl. No.: 09/555,857

(22) PCT Filed: Dec. 17, 1998

(86) PCT No.: PCT/GB98/03692

§ 371 Date: Jun. 6, 2000

§ 102(e) Date: Jun. 6, 2000

(87) PCT Pub. No.: WO99/32827

PCT Pub. Date: Jul. 1, 1999

(30) Foreign Application Priority Data

Dec. 18, 1997 (GB) ..... 9726697

(51) Int. Cl.[7] ..... F23R 3/26
(52) U.S. Cl. ..... 60/39.23; 60/747
(58) Field of Search ..... 60/39.23, 39.29, 60/747

(56) References Cited

U.S. PATENT DOCUMENTS 2,527,732 A * 10/1950 Imbert ..... 60/39.23
3,631,675 A 1/1972 Keiter
3,643,431 A * 2/1972 Jamieson ..... 60/39.23
3,910,035 A 10/1975 Juhasz

FOREIGN PATENT DOCUMENTS

DE 15 23 512 A 8/1969
DE 26 57 707 A 7/1977
GB 785 210 A 10/1957
GB 1 184 683 A 3/1970

* cited by examiner

*Primary Examiner*—Louis J. Casaregola
(74) *Attorney, Agent, or Firm*—Nixon & Vanderhye P.C.

(57) ABSTRACT

A flow controller (5) for supplying air to a combustor and a combustor incorporating the same are disclosed. The flow controller comprising a conduit (6, 7, 8) and a control port (9), the conduit including a main section (8) dividing into at least two secondary sections (6, 7) at a junction and the control port being positioned in the conduit adjacent to the junction. In one embodiment, the control port is connected to a reservoir (10) wherein, in use, a change in the flow rate of a main airflow flowing through the main section of conduit causes a control airflow to flow either into or out of the control port whereby the main airflow is selectively diverted into one or other of the secondary sections of conduit. The main airflow may coanda around a surface of the main section. The control port may also be connected to the conduit further upstream of the junction so as to form a control loop (16). The main section of conduit may comprise a convergent-divergent duct.

12 Claims, 3 Drawing Sheets

COMBUSTOR FLOW CONTROLLER FOR GAS TURBINE

BACKGROUND OF THE INVENTION

1. Filed of the Invention

This invention relates to improved combustor arrangements for gas turbine engines and in particular is concerned with control of air flow to combustor zones.

2. Discussion of Prior Art

The invention relates to improved combustor arrangements for gas turbine engines and in particular is concerned with control of air flow to combustor zones.

Gas turbine engines include an air intake through which air is drawn and thereafter compressed by a compressor to enter a combustor at one or more ports. Fuel is injected into the combustion chamber by means of a fuel injector whence it is atomised, mixed with the compressed air from the various inlet ports and burnt. Exhaust gases are passed out of an exhaust nozzle via a turbine which drives the compressor. In addition to air flow into the combustion chamber through the air inlet ports, air also enters the combustion chamber via the fuel injector itself.

Conventional combustors take a variety of forms. They generally comprise a combustion chamber in which large quantities of fuel are burnt such that heat is released and the exhaust gases are expanded and accelerated to give a stream of uniformly heated gas. Generally the compressor supplies more air than is needed for complete combustion of the fuel and often the air is divided into two or more streams, one stream introduced at the front of the combustion chamber where it is mixed with fuel to initiate and support combustion along with the air in the fuel air mixture from the fuel injector, and one stream is used to dilute the hot combustion product to reduce their temperature to a value compatible with the working range of the turbine.

Gas turbine engines for aircraft are required to operate over a wide range of conditions which involve differing ratios between the mass flows of the combustion and dilution air streams. To ensure a high combustion efficiency, it is usual for the proportion of the total airflow supplied to the burning zone to be determined by the amount of fuel required to be burned to produce the necessary heat input to the turbine at the cruise condition. Often the chamber conditions are stoichiometric in that there is exactly enough fuel for the amount of air; surplus fuel is not completely burnt. However because of variability of the cycles and because air and fuel are never completely mixed there are always some oxides of nitrogen and unburnt fuel residues. An ideal air fuel mixture ratio at cruise usually leads to an over rich mixture in the burning zone at high power conditions (such as take-off) with resultant unburnt hydrocarbon and smoke emission. It is possible to reduce smoke emission at take-off by weakening the burning zone mixture strength but this involves an increase in primary zone air velocity which makes ignition of the engine difficult to achieve, especially at altitude.

The temperature rise of the air in the combustor will depend on the amount of fuel burnt. Since the gas temperature required at the turbine varies according to the operating condition, the combustor must be capable of maintaining sufficient burn over a range of operating conditions. Unwanted emissions rise exponentially with increase in temperature and therefore it is desirable to keep the temperature low. With increasingly stringent legislation against emissions, engine temperature is an increasingly important factor, and operating the combustor at temperatures of less than 2100 K becomes necessary. However at low temperatures, the efficiency of the overall cycle is reduced.

It is a requirement that commercial airliners can decelerate rapidly in the case of potential collision. In order to decelerate a gas turbine from high power to low power, the fuel flow to the engine is reduced. Although the reduction in fuel flow is almost instantaneous, the rate of reduction of engine airflow is relatively slow because of the inertia of rotating parts such as turbines, compressors, shafts etc. This produces a weak mixture of fuel and this increases the risk of flame extinction. It is not always easy to relight the flame especially when the combustor is set to run weakly and at high altitude. Because modern combustors invariably operate in lean burn principles in order to reduce oxide of nitrogen emissions, combustors need to be operated as close to the lean extinction limit at all engine operating conditions. If margins are set wide enough to prevent flame extinction then emissions performance is compromised.

Combustion is initiated and stabilises in the pilot zone, the most upstream section of the combustor. Low power stability requires rich areas within the primary zone of the combustor, enabling combustion to be sustained when the overall air/fuel ratio is much weaker than the flammability limit of kerosene. In traditional combustion systems rich regions can occur in the combustor due to poor mixing and poor atomisation resulting in large droplets of fuel being formed.

Conventional gas turbine engines are thus designed as a compromise rather than being optimised, because of consideration of the above mentioned conflicting requirements at different operating conditions. New "staged" design of combustors overcome the problems to a limited extent. These comprise two combustion zones, a pilot zone and a main zone, each having a separate fuel supply. Essentially this type of combustor is designed such that a fixed flow of about 70% enters the combustor at the main zone and about 30% of the air flows to the pilot zone. In such systems the air/fuel ratio is determined by selecting the amount of fuel in each stage. The air/fuel ratio governs the temperature which determines the amount of emissions. Current gas turbine engine trends are towards increased thrust/weight ratios which require the engine to perform at higher operating compression ratios and wider ranges of combustor air/fuel ratios. Future gas turbine combustion systems will be expected to perform at higher inlet temperatures and richer air/fuel ratios. Because there is little variability in the airflow proportions to the main stage and pilot stage the amount of optimisation achievable for each operating condition is reduced. Even these combustor designs will suffer from either high nitrogen oxide and smoke emissions at full power, or poor stability at low power.

It is therefore desirable to improve control of the amount of fuel, air and air/fuel ratio in each combustor zone to reduce the problems of weak flame extinction, emissions of oxides of nitrogen and unburnt fuel at all operating conditions, whilst maintaining good efficiency and performance.

Conventionally, as shown in GB 785,210, this can be achieved by diverting a main airflow flowing through a main conduit into one of two subsidiary conduits by injecting under pressure into the main airflow a controlling air stream. However, this requires a separate compressor which is disadvantageous in terms of cost and weight. Alternatively, GB 1,184,683 discloses a system whereby a suction action is utilised. However, this is achieved by bleeding compressed air out of the engine resulting in a loss of engine efficiency.

It is an objection of the invention to provide enhanced means by which air flow can be controlled.

SUMMARY OF THE INVENTION

According to a first aspect of the present invention, a flow controller for supplying air to a combustor comprises conduit and a control port, the conduit including a main section dividing into at least two secondary sections at a junction characterised in that the control port is positioned in the conduit adjacent to the junction and connected to a reservoir; and wherein, in use, a change in the flow rate of a main airflow flowing through the main section of conduit causes a control airflow to flow either in to or out of the control port whereby the main airflow is selectively diverted into one or other of the secondary sections of conduit.

A change in the flow rate of a main airflow results in a change in the static pressure of the main airflow which produces a pressure differential between the conduit adjacent to the port and the reservoir. The pressure differential causes the control airflow until pressure equalisation, the duration of the flow depending, amongst other things, on the size of the reservoir.

In an alternative embodiment, a flow controller for supplying air to a combustor comprises conduit and a control port, the conduit including a main section dividing into at least two secondary sections at a junction characterised in that the control port is positioned in the conduit adjacent to the junction; and wherein, in use, a control airflow flowing either in to or out of the control port causes a main airflow flowing through the main section of conduit to coanda around a surface of the main section whereby the main airflow is selectively diverted into one or other of the secondary sections of conduit. Ideally, the flow controller comprises at least one arcuate surface common to both the main section and a secondary section.

A skilled person would interpret coanda in relation to the coanda effect, the coanda effect being the tendency of a fluid jet to attach to a downsteam surface roughly parallel to the jet axis. If this surface curves away from the jet the attached flow will follow it deflecting from the original direction (Dictionary of Science and Technology, Larousse 1995).

Preferably, the control port is connected to the conduit further upstream of the junction so as to form a control loop.

In a further embodiment, a flow controller for supplying air to a combustor comprises conduit and a control port, the conduit including a main section dividing into at least two secondary sections at a junction characterised in that the control port is positioned in the conduit adjacent to the junction and connected to the conduit further upstream of the junction so as to form a control loop; and wherein, in use, a control airflow flowing either in to or out of the control port causes a main airflow flowing through the main section of conduit to be selectively diverted into one or other of the secondary sections of conduit.

Preferably, the main section of conduit comprises a convergent-divergent duct; wherein, in use, the control airflow flowing either in to or out of the control port is caused by a pressure differential across the duct.

According to a second aspect of the present invention, a gas turbine combustor comprises a flow controller as described above. Ideally, the flow controller comprises two secondary sections of conduit connected to two different zones within the combustor. In a preferred embodiment, the flow controller comprises one secondary section of conduit connected to a pilot combustion zone within the combustor and another secondary section of conduit connected to a main combustion zone.

In this way the proportion of flow to the main combustor zone and the pilot zone can be selectively altered without mechanical means. This provides robust control of flow with high reliability.

BRIEF DESCRIPTION OF THE DRAWINGS

A combustor incorporating a flow controller according to the present invention will now be described, by way of example only, with reference to the drawings of which.

DETAILED DISCUSSION OF PREFERRED EMBODIMENTS

Figure 1:
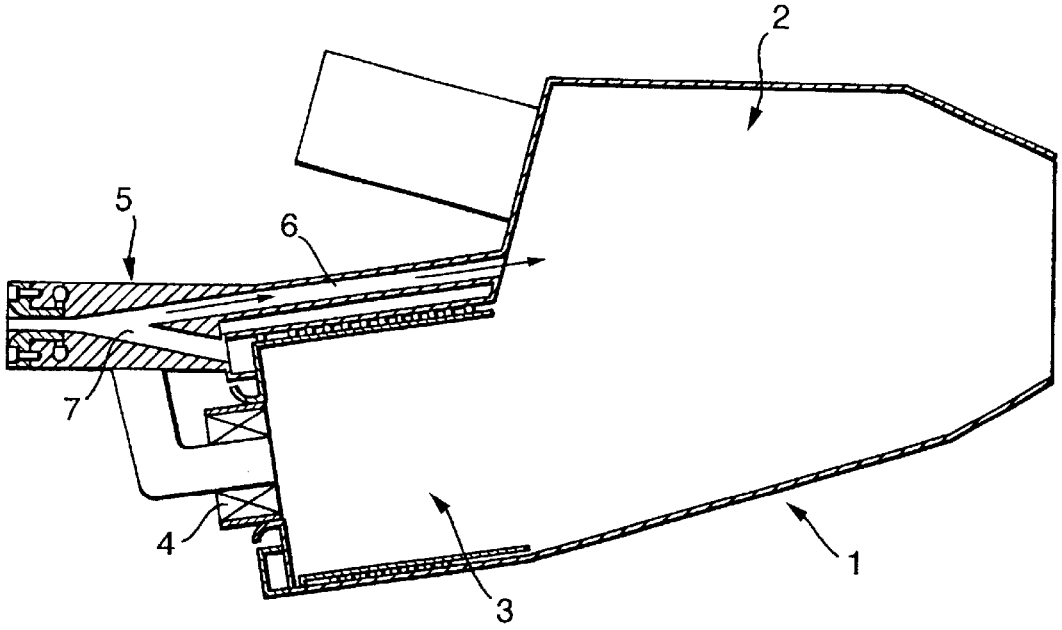
FIG. 1 shows a schematic sectional view of a combustor incorporating a flow controller of the present invention.

FIG. 1 shows a schematic view of a combustor incorporating a flow controller of the present invention. The combustor 1 comprises a main (high power) combustor zone 2 and pilot (low power) 3 combustor zone. Attached to the pilot zone is a primary fuel injector 4. Air flow into the combustor enters the through a common entry point and a flow controller 5 which subdivides into two conduits one, 6, which leads to the main zone and the other, 7 to the pilot zone.

Figure 2:
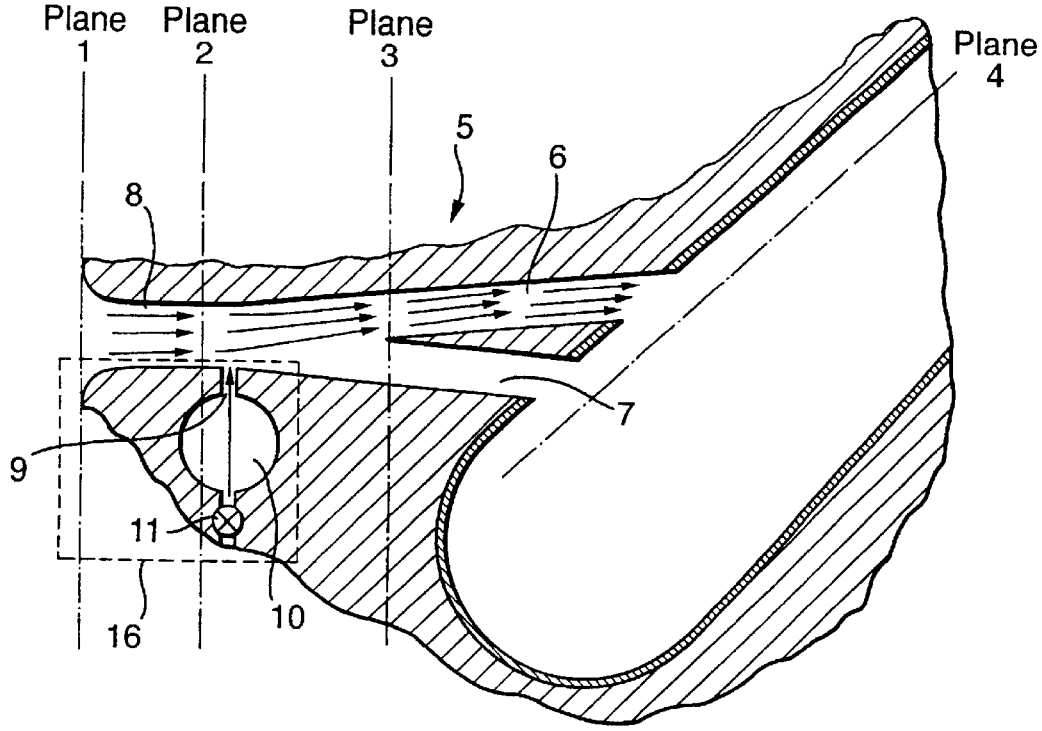
FIG. 2 shows the combustor of FIG. 1 in greater detail.

FIG. 2 shows the flow controller for the combustor in more detail. The figure also shows a series of planes P1 to P4, in order to assist in the description of the flow controller. The air supply to the combustor is from a flow controller which comprises a main conduit 8 which divides into two separate sub conduits at P3, of which one (6) enters the main combustion zone, and the other (7) enters the pilot combustion zone. Upstream of the divergence formed by the subdivision of the conduit is located a control port 9. Port 9 is connected to a reservoir 10 which includes a valve 11 located on the other side which connects to the same pressure as at P1. A pressure difference exists from P1 to P4 such that air flows from P1 to P4. The conduit from P1 to P3 acts as a venturi. From P1 to P2 the flow cross section is such that flow of air accelerates and the static pressure falls to P2 which is lower than P1. This ensures that when valve 11 is open air will flow into the device from the control loop 16 and the control port. Downstream of P2 is a diffuser.

The angle of the diffuser is sufficiently large such that flow will coanda or attach to one or other of the outer walls. Some degree of diffusion and pressure recovery will take place and is essential in order for flow acceleration and pressure reduction at plane 2.

Figure 3A:
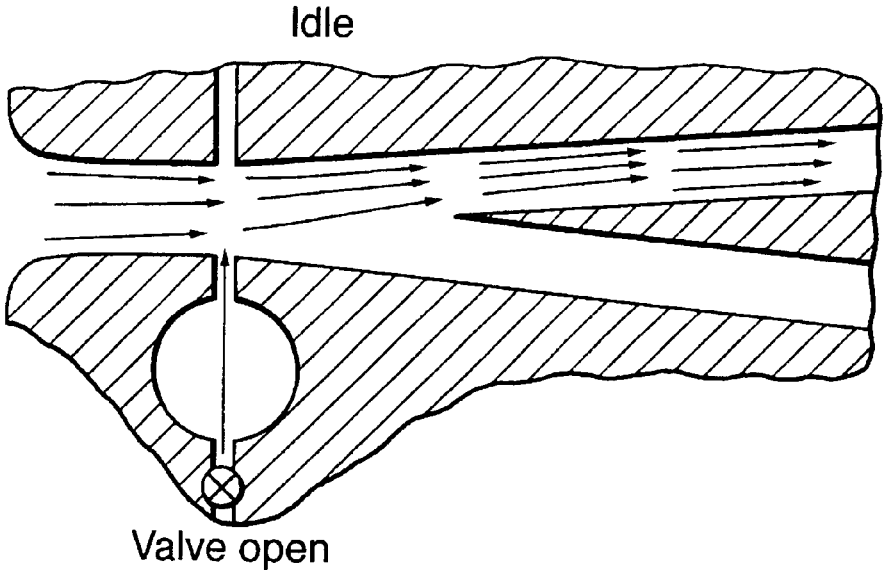
FIGS. 3*a* to *d* show the operation of the flow controller of the combustor of FIG. 1 at various operating conditions.
Figure 3B:
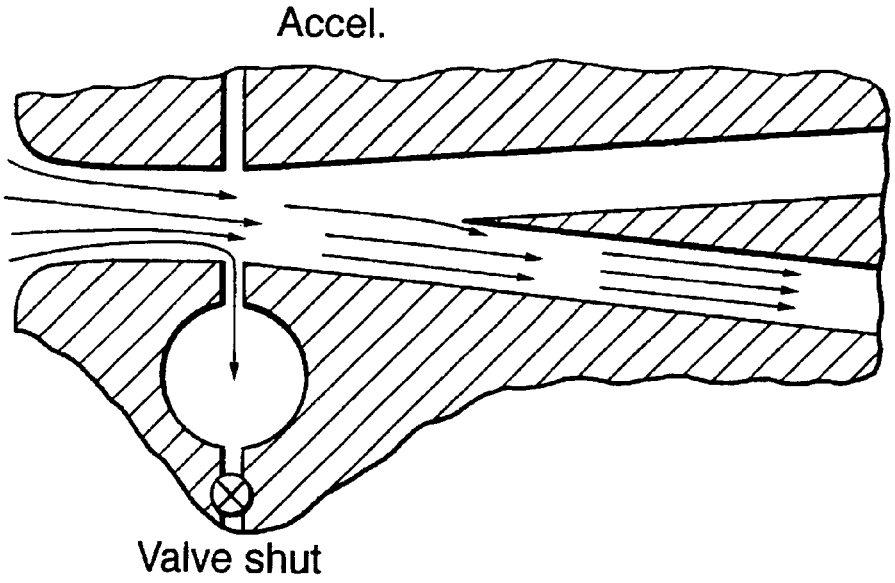
Figure 3C:
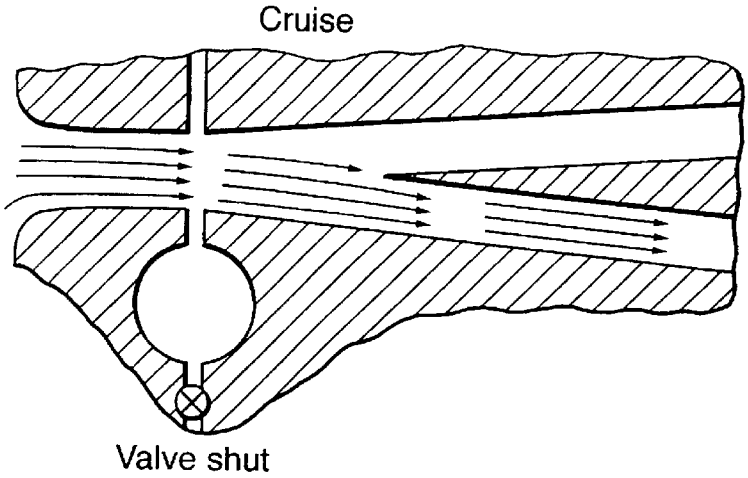
Figure 3D:
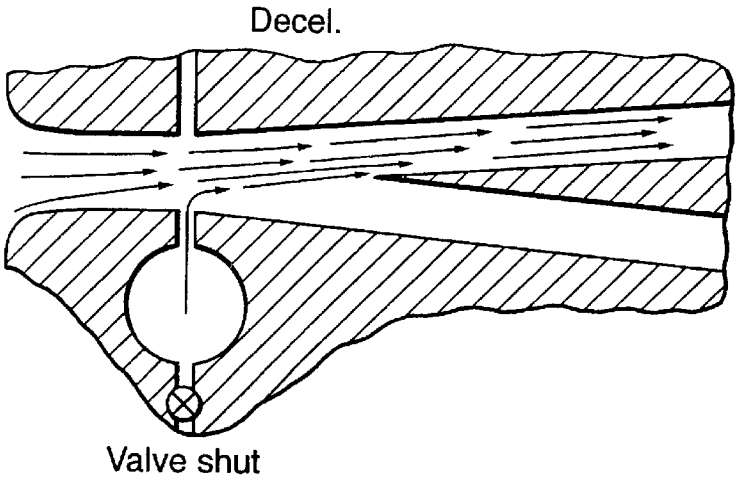

The operation of the embodiment described above will now be described with reference to FIG. 3. FIG. 3*a* shows the operation at idle condition. The reservoir pressure is neutral and the valve is opened such that control flow is injected through control port into the main flow where it acts as a boundary layer trip such as the main flow separates from wall to wall. The air flow now flows through sub conduit 6 to the main zone of the combustor. FIG. 3*b* shows that on acceleration, main flow is switched back to the sub conduit which leads to the pilot zone of the combustor by shutting the valve 11. Control flow is sucked into the control port because the reservoir pressure is low relative to the pressure at P1. FIG. 3*c* shows that at cruise condition the valve remains shut and the reservoir pressure is neutral. Air continues to flow to the pilot zone. On deceleration (FIG. 3*d*) the reservoir pressure is overpressurised and flow out of the control port causes the main flow to divert into the conduit to the main zone.

The above described embodiment describes how control flow through a port in the flow controller can selectively divert flow, and flow control of air to each combustor zone is automatically selected.

In a simple embodiment of the invention, the control flow loop which includes the reservoir and valve is dispensed with. Selective over-pressure or under-pressure at the control port will enable selective diversion of flow air to the respective combustor zones.

Figure 4:
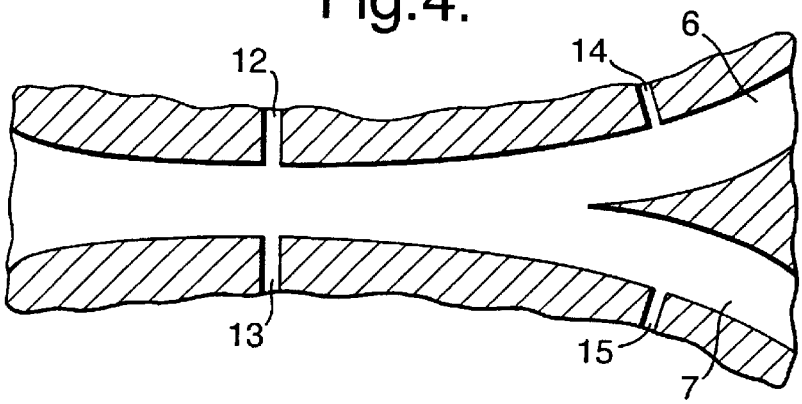
FIG. 4 shows alternative embodiments of the flow controller comprising one or more control ports in various locations.

In the embodiment only one control port is described. However any number of control ports in the vicinity of the divergence will have a controlling effect to direct the main air flow. FIG. 4 shows four possible locations of control ports. Over-pressure (flow into conduit) at any of ports 12 or 14 will tend to divert flow to the sub-conduit 7 and conversely underpressure at any of ports 13 or 15 will tend to divert the flow to this sub-conduit.

Overpressure at any of ports (flow to main conduit) 13 or 15 will divert flow to the sub-conduit 6 and conversely under-pressure in any of ports 12 or 14 will tend to divert the flow to the sub-conduit 7.

The flow controller may contain any number of control ports which supplement each other, for example, a feedback loop comprising a valve of reservoir positioned between a port in the sub-conduit 14 and a port in the subconduit 12 whereby, the diversion of flow, say from subconduit 7 to subconduit 6, is rendered temporary. This is particularly useful for temporary diversion of an airflow to a main combustor zone rather a pilot combustor zone of a combustor such that during sharp deceleration, flame extinction is prevented.

The diverted flow is stable in either of the two states even if there is no applied control flow. However the control flow is preferably provided by selective over-(or under-) pressure at one of two ports 12, 13 oppositely located adjacent the respective sub-conduit.

What is claimed is:

1. A flow controller for supplying air to a turbine engine combustor said controller comprising:

a conduit carrying engine airflow, the conduit including a main section dividing into at least two secondary sections at a junction, said at least two secondary sections comprising main and pilot sections;

a control port, said control port positioned in the conduit adjacent to the junction;

a reservoir fluidly connected to said control port, wherein an increase and decrease in the flow rate of a main airflow through the main section of conduit causes a control airflow to flow out of and into, respectively, the control port selectively diverting said main airflow into said secondary pilot and said secondary main sections, respectively.

2. A flow controller for supplying air to a turbine engine combustor, said controller comprising:

a conduit carrying engine airflow, the conduit including a main section dividing into at least two secondary sections at a junction, said at least two secondary sections comprising main and pilot sections; and a control port, said control port positioned in the conduit adjacent to the junction wherein a control airflow flowing out of and into, respectively, the control port causes a main airflow flowing through the main section of conduit to coanda around a surface of the main section whereby the main airflow is selectively diverted into said secondary pilot and said secondary main sections, respectively.

3. A flow controller according to claim 2 wherein the flow controller comprises at least one arcuate surface common to both the main section and one of said at least two secondary sections.

4. A flow controller according to claim 1 wherein the control port is connected to the conduit upstream of the junction so as to form a control loop.

5. A flow controller for supplying air to a turbine engine combustor, said controller comprising:

a conduit carrying engine airflow, the conduit including a main section dividing into at least two secondary sections at a junction, said at least two secondary sections comprising main and pilot sections; and a control port, said control port positioned in the conduit adjacent to the junction, wherein the control port is connected to the conduit upstream of the junction so as to form a control loop, wherein a control airflow flowing out of and into, respectively, the control port diverts said engine airflow into said secondary pilot and said secondary main sections, respectively.

6. A flow controller according to claim 4 wherein the main section of conduit comprises a convergent-divergent duct; wherein, the control airflow flowing through the control port is caused by a pressure differential across the duct.

7. A gas turbine combustor comprising:

a gas turbine engine combustor having at least two different secondary zones; and a flow controller according to claim 1 wherein said secondary main section is fluidly connected to one of said at least two different secondary zones and said secondary pilot section is fluidly connected to the other of siad at least two different secondary zones.

8. A gas turbine combustor according to claim 7 wherein the secondary main and pilot sections of conduit connected to main and pilot zones, respectively, within the combustor.

9. A gas turbine combustor according to claim 7 wherein the flow controller comprises one secondary section of conduit connected to a pilot combustion zone within the combustor and another secondary section of conduit connected to a main combustion zone within the combustor.

10. A flow controller for supplying air to a turbine engine combustor where said combustor has main and pilot sections, said turbine engine having a source of high pressure air, said controller comprising:

a conduit from said source of high pressure air to said combustor, said conduit including an upper stream main section and, at a junction, a down stream section divided into a main section and a pilot section for providing airflow to said main and pilot sections, respectively, said main section and said junction comprising a structure for maintaining airflow substantially in one of said main section and said pilot section unless diverted;

a control port, said port positioned in said main section adjacent to the junction, for changing airflow between said main section and said pilot section; and a reservoir fluidly connected to said control port, wherein, during acceleration of said engine, an increase in main section air flow rate causes a control airflow to flow into the control port and the reservoir, diverting main section airflow at said junction to said pilot section, and during deceleration of said engine, a decrease in main section air flow rate causes a control outflow out of the control port and the reservoir, diverting main section airflow at said junction to said main section.

11. The flow controller in accordance with claim 10, wherein said reservoir has a fixed volume during idle, acceleration, cruise, and deceleration phases of engine operation.

12. The flow controller in accordance with claim 11, wherein said reservoir includes a valve which, during engine start operation, is at least partially open and supplies high pressure air to said reservoir causing said control outflow out of the control port and the reservoir, and diverting main section airflow at said junction to said main section.

* * * * *